US005715876A

United States Patent [19]

Burt

[11] Patent Number: 5,715,876

[45] Date of Patent: Feb. 10, 1998

[54] FUEL SPILL CONTAINMENT DEVICE

[76] Inventor: William D. Burt, Box 27185, Panama City, Fla. 32411

[21] Appl. No.: 684,629

[22] Filed: Jul. 22, 1996

[51] Int. Cl.[6] ..... B65B 3/04

[52] U.S. Cl. ..... 141/86; 114/343; 248/205.5; 248/205.9; 248/206.1; 248/309.3; 248/206.3

[58] Field of Search ..... 141/86; 114/343; 248/205.5, 205.8, 205.9, 206.1, 206.3, 309.3

[56] References Cited

U.S. PATENT DOCUMENTS

| | | | |
|---|---|---|---|
| D. 357,557 | 4/1995 | Piper | 248/206.1 X |
| 641,893 | 1/1900 | Roberts | 248/206.1 |
| 2,915,271 | 12/1959 | Ruttger | 248/206.3 |
| 2,918,282 | 12/1959 | Waterval | 248/205.9 X |
| 3,180,604 | 4/1965 | Hammer | 248/205.8 |
| 3,649,069 | 3/1972 | Zip | 248/205.9 X |
| 4,082,125 | 4/1978 | Wilson | 141/86 |
| 4,802,514 | 2/1989 | Morse | 141/86 |
| 4,836,482 | 6/1989 | Sokol | 248/206.3 |
| 4,846,429 | 7/1989 | Scheurer | 248/205.8 |
| 5,020,754 | 6/1991 | Davis et al. | 248/206.3 |
| 5,029,787 | 7/1991 | Florentin | 248/206.3 |
| 5,070,806 | 12/1991 | Coster | 114/343 |
| 5,381,990 | 1/1995 | Belokin et al. | 248/205.9 |
| 5,398,602 | 3/1995 | Taylor | 248/205.8 |

*Primary Examiner*—J. Casimer Jacyna
*Attorney, Agent, or Firm*—Cort Flint

[57] ABSTRACT

A fuel spillage containment device is disclosed which is user-friendly and may be mounted to the hull of a boat beneath the fuel vent of the boat for collecting fuel spillage during refueling in a single handed operation. The device may be released and removed from the boat in the same single handed operation in a reliable manner that assures that fuel spillage is prevented from the collector of the device even when nearly full of fuel. The device includes a frame which carries spaced suction cups for affixation to the hull having a release mechanism for releasing the suction cups. The frame is affixed to the collector in a balanced configuration with respect to operation of said handle and release mechanism by means of flexible connector arms which may be bent to a desired position to assure the collector is properly mounted beneath the fuel vent for collecting fuel spillage.

15 Claims, 2 Drawing Sheets

Fig. 3.
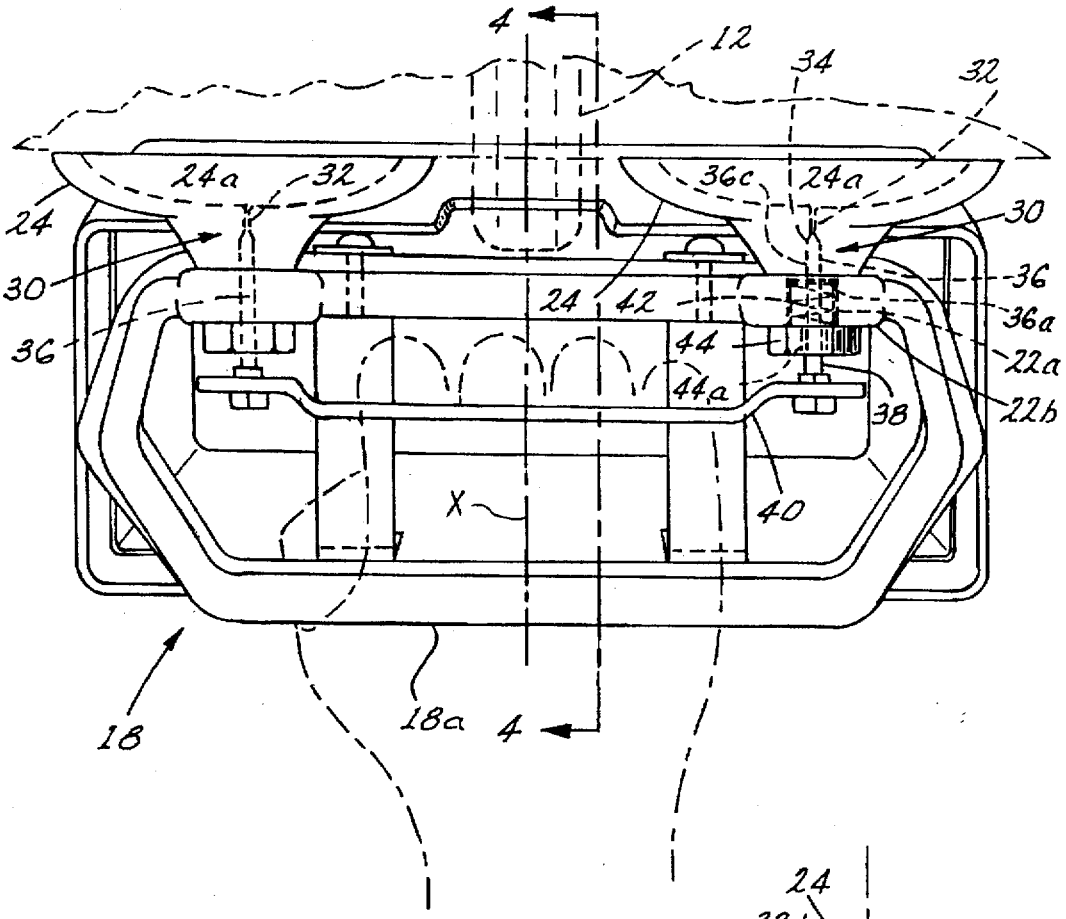
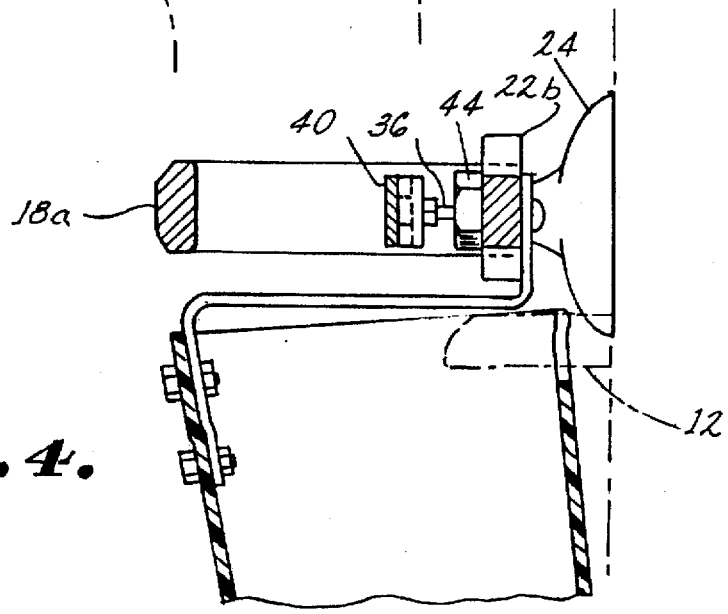
Fig. 4.

FUEL SPILL CONTAINMENT DEVICE

BACKGROUND OF THE INVENTION

This invention relates to the containment of fuel spill during refueling of watercraft or marine vessels in harbors and marinas.

Marina employees pump fuel daily from a dock into the fuel tank of watercraft. Each time this happens, there is a possibility of fuel spilling into the water either directly, or indirectly through the fuel vent of the boat or watercraft. In 1990, the Oil Pollution Act of 1990 ("OPA") was placed into effect. While the act applies first and foremost to large oil tankers and large facilities, it also applies to small marine vessels as well as commercial and recreational boat facilities. Increasingly, OPA is being applied to recreational boat facilities such as marinas. With the increase popularity of boating and numbers of watercraft, the problem of fuel spillage at marina's is a problem to which considerable attention need be given. Not only is the problem increasing, but increased enforcement against such spillage is increasing the chances for marina liability.

A responsible party may be liable for removal costs incurred by the Federal, State, or Municipal Government. The responsible party may also be liable for natural resource damage, damages for injury to or economic losses resulting to real or personal property, damages for loss of natural resources. Finally, there is the potential for penalties for the unauthorized discharge of fuel and oil including penalties as high as $25,000 per day or amounts of up to three times the cost incurred by Federal or State authorities in cleaning up and removing the fuel or oil.

Previously, devices have been proposed to avoid the spillage of fuel from the fuel vent line such as an air/fuel separator device which is intended to be installed in the fuel vent line of the watercraft. However the device has not been very successful because vent lines can be hard to gain access to, and a single yacht may require as many as four separators.

Receptacles to catch an over flow of spillage from the fuel vent of boats during refueling has been proposed in the U.S. Pat. Nos. 4,802,514 and 5,070,806. The first patent discloses a fuel spillage prevention receptacle for use on boats that is mounted on the hull of the boat by one or more suction cup members beneath the outlet of the fuel tank air vent. However, the problem occurs in that it is difficult to remove the receptacle without spilling fuel, particularly when it is full and a force is applied to the device for removal. Furthermore, there is little if any adjustment provided to fit the receptacle to various shaped hulls or to handle the device when attaching and unattaching the receptacle to the hull.

U.S. Pat. No. 4,082,125 discloses a device for preventing water pollution by collecting liquid fuel overflow from fuel tanks for boats and similar vessels wherein a support ring is mounted to the external surface of the hull of the boat, and a receptacle is adapted to be mounted on the support ring. However, this requires a special retainer ring to be mounted onto the hull of the boat, and is not readily useable for marina use where the device must be taken on and off boats during refueling by the marina operator. Nor does the device provide a portable device which may be used generally by the boat owner without the need of a special retainer ring.

It is noted, that the mounting and removal of a containment device at the fuel vent of a watercraft is a manual operation which requires some dexterity and skill since the watercraft is often moving with the water and the marina attendant or boat owner is either on the dock holding on to the watercraft, or is leaning over the hull of the watercraft. Accordingly, there is a need to have a containment device which can be easily and conveniently mounted and removed from the hull of the watercraft in a gentle manual operation in which preferably only one hand is needed.

Thus, it can be seen that the provision of a convenient and reliable fuel vent containment device which can be easily mounted to the hull of a watercraft for catching vented fuel and which can be skillfully removed without fuel spillage is a problem to which considerable attention is required.

Accordingly, an important object of the present invention is to provide a fuel vent containment device which can be easily mounted to the hull of a watercraft at the fuel vent and skillfully removed without spillage of fuel.

Another object of the present invention is to provide a fuel vent containment device for catching fuel spillage from a boat fuel vent which may be mounted to the hull of the watercraft using suction cups and which may be easily removed by releasing the vacuum and removing the device in a single handed operation.

Yet another object of the recent invention is to provide a fuel vent containment device which is easily mounted to the hull of a watercraft near the fuel vent and which may be easily adjusted to fit a wide variety of hull shapes.

SUMMARY OF THE INVENTION

The above objectives are accomplished according to the present invention by providing a fuel vent containment device which is user friendly and may be mounted to the hull of an associated watercraft beneath a fuel vent for collecting fuel spillage during refueling of the watercraft. The containment device includes:

a collector for collecting and containing fuel spillage from the fuel vent during refueling; and a frame connected to the collector for carrying the collector in a proper position beneath the fuel vent:

A plurality of laterally spaced suction cups are carried by the frame for securing the frame and collector to the hull with the collector properly positioned beneath the fuel vent:

A release mechanism is carried by the frame for releasing the suction of the suction cups when applied against the hull of the watercraft so that the collector may be reliably removed from the hull after refueling without fuel spillage; and an actuator for actuating the release mechanism by a user.

The frame includes a handle which may be manually grasped by a hand of the user, and the actuator comprises an actuator member which can be grasped by the hand of the user in a manner that the release mechanism may be actuated and the collector removed in a manual single handed operation.

The release mechanism preferably comprises a valve having a vent passage opening into a suction space of the suction cups as applied to the hull passage extending from the suction cavity of the suction cups to the ambient. The actuator is connected to the valve element so that the valve passage is thereby selectively opened and closed.

The suction cups are advantageously spaced generally equidistantly about a center axis of the collector, and the actuator and handle are generally bisected by the center axis for a balanced device.

At least one connector arm is connected between the frame and the collector whereby the collector is carried by the frame having an adjustment enabling the adjustment of the collector relative to the frame to assure proper positioning of the collector beneath the fuel vent.

The adjustment of the adjustable arm preferably includes the arm being constructed from a bendable material so that the arm may be bent and set in a desired position so that the collector is properly positioned below the fuel vent.

In the illustrated embodiment, the device includes a plurality of the bendable connector arms connected between the frame and the collector for adjustment of the collector relative to the frame.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 3 is a top plan view of a fuel spillage containment device according to the invention affixed to the side of the boat hull beneath a fuel vent of the boat for collecting fuel spillage during refueling illustrating the grasping of a handle and release in a single handed operation; and FIG. 4 is a sectional view taken along 4—4 FIG. 3.

DESCRIPTION OF A PREFERRED EMBODIMENT

Figure 1:
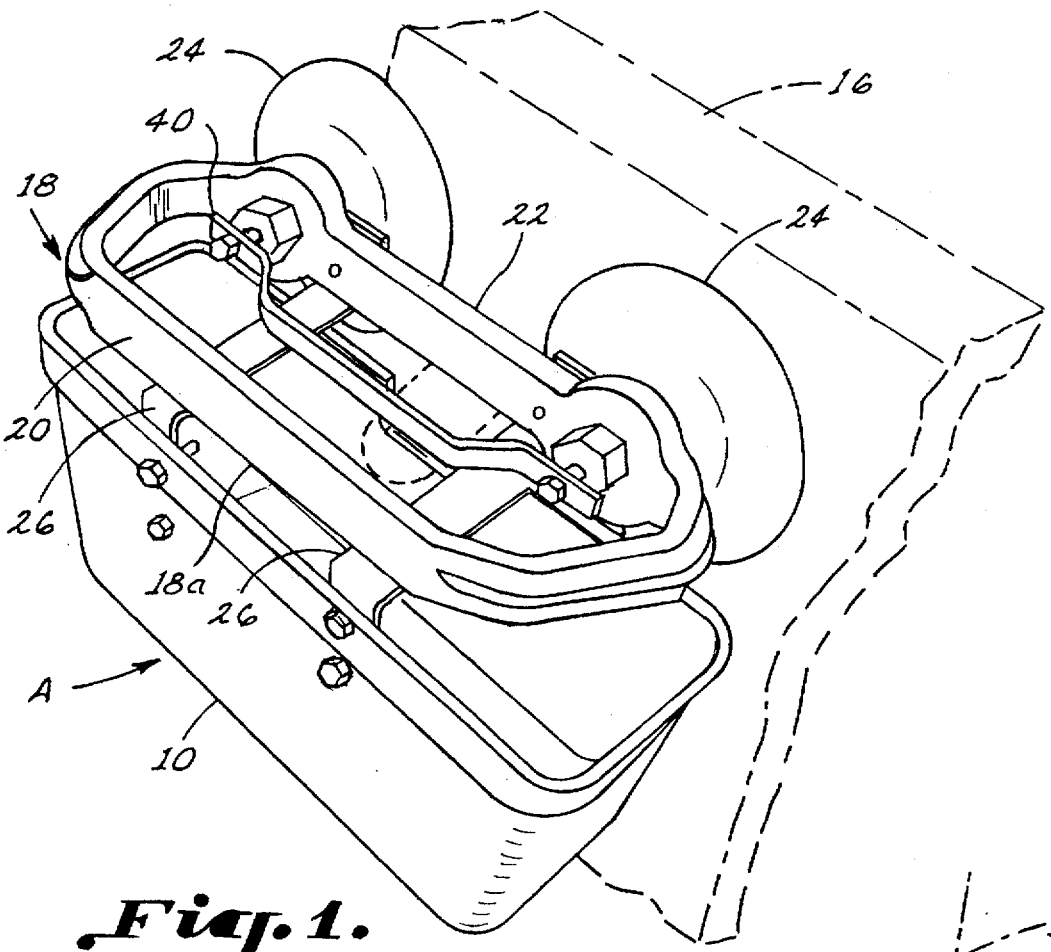
FIG. 1 is a perspective view illustrating a fuel spillage containment device constructed according to the invention affixed to the side of a boat hull for collecting fuel spillage from an associated fuel vent of the boat.
Figure 2:
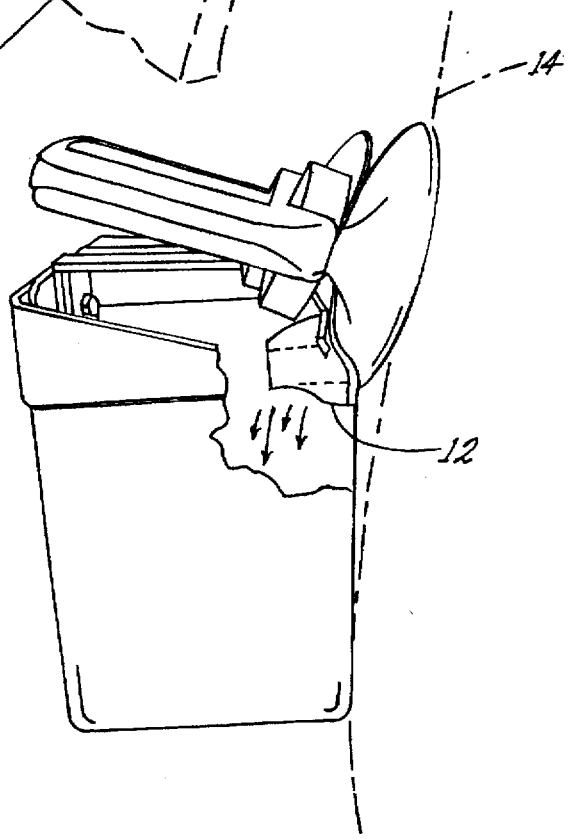
FIG. 2 is a side view illustrating the fuel spillage containment device according to the invention affixed to the side of the boat hull.

Referring now in more detail to the drawings, the invention will now be described in more detail. As can best be seen in FIG. 1, a fuel vent containment device, designated generally as A, is illustrated which includes a collector 10 for collecting fuel spillage from a fuel vent 12 extending through the hull 14 of an associated watercraft or boat 16. Collector 10 is preferably constructed from a plastic or other fuel-resistant material. Collector 10 is carried by a frame, designated generally as 18, which includes a handle 20 and an opposing support bar 22 which carries a pair of spaced suction cups 24. While a pair of spaced suction cups is illustrated, one or more suction cups is contemplated by the invention. However, the pair of suction cups is preferred to balance the collector when loaded more fully with fuel spillage. A pair of arms 26 mount frame 18 to collector 10. Preferably arms 26 are made from a bendable material, so that the arms may be bent and set in a desired position so that collector 10 is mounted flush against the hull with suction cups 24 in place against the hull. This assures a proper fit for maximizing the prevention of fuel spillage depending on the shape of hull to which the device is being applied. For this purpose, arms 26 may be made from a suitable flexible material or metal such as aluminum. Arms 26 may be adjusted and the device attached where upon the device may be removed and the arms readjusted if the fit is not proper. For this and other reasons, it will be seen the combination of elements in the device provide an expedient for an highly user friendly, fuel vent containment device.

To ensure reliable removal of the containment device without fuel spillage in the event the collector contains a large amount of fuel, a release mechanism, designated generally as 30, is provided, as can best be seen in FIGS. 3 and 4. The suction release mechanism includes a vent passage 32 terminating in a valve seat 34 which is selectively opened and closed by a valve element 36. Valve element 36 includes an elongated needle valve having a remote end 38 affixed to an actuator 40. As can best seen in FIG. 3, there are identical release mechanisms 30 for each suction cup 24. Valve element 36 includes a fixed flange **36*a* carried near the seat end which is received enlarged bore 22*a*. Bore 22*a* is formed in an enlarged boss 22*b* of support bar 22. There is a spring 42 carried between flange 36*a* and an attachment nut 44. Spring 42 is compressed as actuator 40 is pulled rearward by the fingers or forward palm portion of the hand when grasping handle 18*a* of the frame, so that valve element 36 is moved off of valve seat 34 as can best be seen in FIG. 3. In this manner, the vacuum inside cup space 24*a* is relieved through vent passage 36*c* which is slightly larger than element 36, a bore 22*a*, and 46 which extends through attachment nut 44. A release mechanism can be constructed as described, or a commercial vacuum assembly can be adapted and utilized as is available in the plate handling industry such as a "CRL Vacuum Cup" lifter assembly available from the CR Laurence Company of Orlando, Fla. As can best be seen in FIG. 3, suction cups 24 are spaced equidistantly about a center line "X" of the device which also generally bisects handle 18*a* and actuator 40** so that a balanced, user-friendly device is had.

Thus it can seen that highly advantageous construction can be had for a fuel vent containment device wherein the device may be easily adjusted to fit a desired hull shape and easily and reliably mounted and released from the hull, even when full of fuel, in a single handed operation. The fuel collector is carried by the frame so as to have a center axis which generally bisects the handle and actuator member so that a balanced configuration is provided and the handle and actuator member of the release mechanism may be manually grasped by a hand of the user in a manner that the release mechanism is actuated and the collector removed in a balanced single handed operation.

In use, with arms 26 properly adjusted, the device is mounted to the hull of a watercraft by means of suction cups 24. In mounting the device to the hull, the device may be easily grasped by a single hand to apply the suction cups to the hull. The other hand may be used for balancing the user who may be on the dock or on the watercraft. In removing the device, again, only a single hand is required as the user grasps the handle and squeezes the actuator to release the device. The device provides the expedient both of a firm grip and balancing of a full collector without fuel spillage while maintaining one hand free for the user for control.

While a preferred embodiment of the invention has been described using specific terms, such description is for illustrative purposes only, and it is to be understood that changes and variations may be made without departing from the spirit or scope of the following claims.

What is claimed is:

1. A fuel vent containment device which is user friendly for mounting to a hull of an associated watercraft beneath a fuel vent for collecting fuel spillage during refueling of said watercraft comprising:

a collector adapted for attachment to the watercraft hull for collecting and containing fuel spillage from said fuel vent during refueling, said collector having an open top adapted for receiving the fuel spillage from the fuel vent of the watercraft;

a frame connected to the collector for carrying said collector in a proper position beneath said fuel vent;

a plurality of laterally spaced suction cups carried by said frame for securing said frame and collector to said hull with the collector properly positioned beneath said fuel vent;

a suction release mechanism carried by said frame for releasing the suction of said suction cups when applied against said hull of said watercraft so that said collector may be reliably removed from said hull without fuel spillage;

an actuator for actuating said suction release mechanism by a user; and said frame including a handle which may be manually grasped by a first hand of said user, and said actuator including an actuator member which can be simultaneously grasped by said first hand of said user while grasping said handle in a manner that said release mechanism may be actuated and said collector removed in a manual single handed operation for smooth removal of said collector from the watercraft hull generally without spillage of the fuel from said open top of said collector.

2. The device of claim 1 wherein said release mechanism comprises a valve having a vent passage opening into a suction space of said suction cups as applied to said hull passage extending from said suction space of said suction cups to the ambient, and said actuator being connected to said valve element so that said valve passage is thereby selectively opened and closed.

3. The device of claim 1 wherein said suction cups are spaced generally equidistantly about a center axis of said collector, and said actuator and handle are generally bisected by said center axis.

4. The device of claim 1 including at least one connector arm connected between said frame and said collector whereby said collector is carried by said frame.

5. The device of claim 4 wherein said arm includes an adjustable connector arm having an adjustment enabling the adjustment of said collector relative to said frame to assure proper positioning of said collector beneath said fuel vent.

6. The device of claim 5 wherein said adjustment of said adjustable arm includes said arm being constructed from a bendable material so that said arm may be bent and set in a desired position so that said collector is properly positioned below said fuel vent.

7. The device of claim 6 wherein said device includes a plurality of said bendable connector arms connected between said frame and said collector for adjustment of said collector relative to said frame.

8. A fuel vent containment device which is user friendly for mounting to a hull of an associated watercraft beneath a fuel vent for collecting fuel spillage during refueling of the watercraft comprising:

a collector adapted for attachment to said watercraft hull for collecting and containing fuel spillage from said fuel vent during refueling;

a frame connected to said collector for carrying said collector in a proper position beneath said fuel vent;

a plurality of laterally spaced suction cups carried by said frame for securing said frame and collector to said hull with said collector properly positioned beneath said fuel vent;

at least one connector arm connected between said frame and said collector whereby said collector is carried by said frame;

said connector arm including an adjustable connector arm having an adjustment enabling the adjustment of said collector relative to said frame to assure proper positioning of said collector beneath said fuel vent;

said adjustment of said adjustable connector arm including said connector arm being constructed from a bendable material so that said arm may be adjusted to a desired position so that said collector is properly positioned below said fuel vent;

a release mechanism carried by said frame for releasing the suction of said suction cups when applied against said hull of said watercraft so that said collector may be reliably removed from said hull without fuel spillage;

an actuator for actuating said release mechanism by a user; and said frame including a handle which may be manually grasped by a hand of said user, and said actuator comprises an actuator member which can be grasped by said hand of said user in a manner that said release mechanism may be actuated and said collector removed in a manual operation by a single handed operation.

9. The device of claim 8 wherein said release mechanism comprises a valve having a vent passage opening into a suction space of said suction cups as applied to said hull extending from said suction cavity of said suction cups to the ambient, and said actuator being connected to said valve element so that said valve passage is thereby selectively opened and closed.

10. The device of claim 8 wherein said suction cups are spaced generally equidistantly about a center axis of said collector, and said actuator and handle are generally bisected by said center axis.

11. The device of claim 8 wherein said device includes a plurality of said bendable connector arms connected between said frame and said collector for adjustment of said relative to said frame.

12. A fuel vent containment device which is user friendly for mounting to a hull of an associated watercraft beneath a fuel vent for collecting fuel spillage during refueling of the watercraft comprising:

a collector adapted for attachment to the watercraft hull for collecting and containing fuel spillage from said fuel vent during refueling;

a frame connected to said collector for carrying said collector in a proper position beneath said fuel vent;

said frame having a handle portion for being manually grasped by a user;

a plurality of laterally spaced suction cups carried by said frame for securing said frame and collector to said hull with said collector properly positioned beneath said fuel vent;

a release mechanism carried by said frame for releasing the suction of said suction cups when applied and secured against said hull of said watercraft so that said collector may be reliably removed from said hull without fuel spillage;

an actuator for actuating said release mechanism by said user having a manual actuator member; and said collector being carried by said frame so as to have a substantially center axis which generally bisects said handle and actuator member to provide a balanced configuration so that said handle and actuator member may be manually and simultaneously grasped by a first hand of said user in a manner that said release mechanism may be actuated and said collector removed in a balanced single handed operation.

13. The device of claim 12 wherein said suction cups are spaced generally equidistantly about said center axis of said collector which generally bisects said handle and actuator member.

14. The device of claim 12 wherein said device includes a plurality of bendable connector arms connected between said frame and said collector for adjustment of said relative to said frame, and said connector arms being generally equidistantly space relative to said center axis of said collector.

15. The device of claim 8 wherein said frame includes a handle which may be manually grasped by a first hand of said user, and said actuator includes an actuator member which can be simultaneously grasped by said first hand of said user while grasping said handle in a manner that said release mechanism may be actuated and said collector removed in a manual single handed operation for smooth removal of said collector from the watercraft hull generally without spillage of the fuel from said collector.

* * * * *